US009758182B2

(12) United States Patent
Peckham et al.

(10) Patent No.: US 9,758,182 B2
(45) Date of Patent: Sep. 12, 2017

(54) AUTOMATED COUPLER POSITIONING DEVICE

(71) Applicant: WABTEC HOLDING CORP., Wilmerding, PA (US)

(72) Inventors: Jason Daniel Peckham, Cato, NY (US); William Clay Swindler, Greer, SC (US); Kevin Scott Brown, Greer, SC (US)

(73) Assignee: Wabtec Holding Corp., Wilmerding, PA (US)

( * ) Notice: Subject to any disclaimer, the term of this patent is extended or adjusted under 35 U.S.C. 154(b) by 370 days.

(21) Appl. No.: 14/221,649

(22) Filed: Mar. 21, 2014

(65) Prior Publication Data

US 2014/0284297 A1 Sep. 25, 2014

Related U.S. Application Data

(60) Provisional application No. 61/804,470, filed on Mar. 22, 2013.

(51) Int. Cl.
*B61G 7/12* (2006.01)
*B61G 5/08* (2006.01)

(52) U.S. Cl.
CPC *B61G 7/12* (2013.01); *B61G 5/08* (2013.01)

(58) Field of Classification Search
CPC ..... B61G 5/08; B61G 7/08; B61G 7/12
USPC ..... 213/104, 149, 150, 174
See application file for complete search history.

(56) References Cited

U.S. PATENT DOCUMENTS

| | | | |
|---|---|---|---|
| 325,923 | A | 9/1885 | Ferguson |
| 346,881 | A | 8/1886 | Zeigler |
| 472,328 | A | 4/1892 | Baylor |
| 1,344,780 | A | 6/1920 | Van Dorn |
| 1,468,057 | A | 9/1923 | Walker |
| 2,150,330 | A | 3/1939 | Kurtossy |
| 2,161,724 | A | 6/1939 | Scharfenberg |
| 2,183,990 | A | 12/1939 | Dunn |
| 2,246,406 | A | 6/1941 | Wittmer |
| 2,276,167 | A | 3/1942 | Dalton |
| 2,380,303 | A | 7/1945 | Geiger |
| 2,451,551 | A | 10/1948 | Haseltine |
| 2,504,253 | A | 4/1950 | Dath |
| 2,639,821 | A | 5/1953 | Danielson |

(Continued)

FOREIGN PATENT DOCUMENTS

| | | |
|---|---|---|
| AT | 202184 | 2/1959 |
| AT | 250430 B | 11/1966 |

(Continued)

*Primary Examiner* — Zachary Kuhfuss
(74) *Attorney, Agent, or Firm* — The Webb Law Firm

(57) ABSTRACT

A coupler for a railway car including a coupler anchor, a coupler mechanism pivotable relative to the coupler anchor from an on-center position to an off-center position in a substantially horizontal plane, and a coupler positioning device for pivoting the coupler mechanism relative to the coupler anchor. The coupler positioning device includes a controller adapted for receiving signal information from a bogie relating to an angular position of the bogie relative to a body of the railway car, and at least one pneumatic cylinder for pivoting the coupler mechanism. The controller controls the operation of the at least one pneumatic cylinder in response to the signal information received from the bogie.

21 Claims, 12 Drawing Sheets

(56) References Cited

U.S. PATENT DOCUMENTS

| | | | | | |
|---|---|---|---|---|---|
| 2,825,473 | A | | 3/1958 | Metzger | |
| 2,897,982 | A | | 8/1959 | Larsson | |
| 2,994,442 | A | | 8/1961 | Frederick | |
| 3,152,699 | A | | 10/1964 | Vickerman | |
| 3,211,298 | A | | 10/1965 | Wison et al. | |
| 3,349,926 | A | * | 10/1967 | Cope | B61G 7/02 213/16 |
| 3,365,078 | A | * | 1/1968 | Hathorn | B61G 7/12 213/15 |
| 3,520,421 | A | | 7/1970 | Gutridge | |
| 3,536,314 | A | | 10/1970 | Tonne et al. | |
| 3,610,435 | A | * | 10/1971 | Randolph | B61G 7/12 213/15 |
| 3,642,149 | A | * | 2/1972 | Chierici | B61G 7/12 213/15 |
| 3,655,066 | A | | 4/1972 | Metzger | |
| 3,710,951 | A | | 1/1973 | Cope | |
| 3,715,139 | A | | 2/1973 | Tuggle | |
| 3,717,260 | A | * | 2/1973 | Jeffrey | B61G 9/06 213/14 |
| 3,741,406 | A | | 6/1973 | Anderson | |
| 3,774,775 | A | | 11/1973 | Allen | |
| 3,809,251 | A | * | 5/1974 | Chierici | B61G 7/08 213/15 |
| 4,013,175 | A | * | 3/1977 | Klein | B61G 7/12 213/20 |
| 4,311,244 | A | | 1/1982 | Hindin et al. | |
| 4,611,821 | A | | 9/1986 | Jeanson et al. | |
| 4,627,545 | A | | 12/1986 | Herbert et al. | |
| 4,927,035 | A | | 5/1990 | Geng et al. | |
| 4,982,488 | A | | 1/1991 | Ragsdale, Sr. | |
| 5,139,161 | A | | 8/1992 | Long | |
| 5,344,542 | A | | 9/1994 | Maher et al. | |
| 5,503,280 | A | | 4/1996 | Hanano et al. | |
| 5,509,548 | A | | 4/1996 | Kreher | |
| 5,687,860 | A | | 11/1997 | Behrens et al. | |
| 5,954,211 | A | | 9/1999 | Grau et al. | |
| 6,095,618 | A | * | 8/2000 | Heneka | B60L 15/32 246/167 R |
| 6,276,542 | B1 | * | 8/2001 | McCrary | B61B 15/00 213/75 R |
| 6,390,314 | B1 | | 5/2002 | Pinlam et al. | |
| 7,070,062 | B2 | | 7/2006 | Trescott | |
| 7,175,036 | B2 | | 2/2007 | Sommerfeld et al. | |
| 7,467,724 | B2 | | 12/2008 | Voong et al. | |
| 7,708,157 | B2 | | 5/2010 | Kemper | |
| 8,297,419 | B2 | | 10/2012 | Gansweidt | |
| 2004/0022619 | A1 | * | 2/2004 | Spatafora | B65H 3/322 414/796.9 |
| 2005/0145591 | A1 | | 7/2005 | Mattschull et al. | |
| 2005/0279726 | A1 | | 12/2005 | Trescott | |
| 2007/0084818 | A1 | | 4/2007 | Brabb et al. | |
| 2009/0065317 | A1 | | 3/2009 | Gansweidt | |
| 2010/0038334 | A1 | | 2/2010 | Kontetzki | |
| 2012/0199545 | A1 | | 8/2012 | Peckham | |
| 2012/0255926 | A1 | | 10/2012 | Peckham | |
| 2014/0218219 | A1 | * | 8/2014 | Inomata | G01C 22/02 340/992 |

FOREIGN PATENT DOCUMENTS

| | | | | | |
|---|---|---|---|---|---|
| AT | 307493 | B | | 4/1973 | |
| AT | 375316 | B | | 7/1984 | |
| CA | 1229324 | A | | 11/1987 | |
| CH | 395172 | A | | 7/1965 | |
| CN | 2880620 | Y | | 3/2007 | |
| CN | 101044050 | A | | 9/2007 | |
| DE | 1017201 | B | | 10/1957 | |
| DE | 1021409 | B | | 12/1957 | |
| DE | 1530196 | A1 | | 5/1970 | |
| DE | 20120581 | U1 | | 6/2003 | |
| DE | 102004045529 | | * | 2/2006 | G01B 21/22 |
| EP | 0583604 | A1 | | 2/1994 | |
| EP | 1447297 | A1 | | 8/2004 | |
| GB | 876173 | | | 8/1961 | |
| GB | 924143 | | | 4/1963 | |
| GB | 952058 | | | 3/1964 | |
| GB | 1296047 | | | 11/1972 | |
| GB | 1360248 | | | 7/1974 | |
| GB | 1393310 | | | 5/1975 | |
| JP | 958468 | A | | 3/1997 | |
| JP | 2004331074 | A | | 11/2004 | |
| JP | 2008254542 | A | | 10/2008 | |
| JP | 201111653 | A | | 1/2011 | |
| JP | 4673333 | B2 | | 4/2011 | |
| WO | WO 2014188712 | | * | 11/2014 | B61G 7/12 |

* cited by examiner

AUTOMATED COUPLER POSITIONING DEVICE

CROSS REFERENCE TO RELATED APPLICATIONS

This application claims the benefit of U.S. Provisional Patent Application No. 61/804,470, filed Mar. 22, 2013, and entitled "Automated Coupler Positioning Device", the disclosure of which is hereby incorporated in its entirety by reference.

BACKGROUND OF THE INVENTION

Field of the Invention

The present disclosure is directed to couplers for railway cars, and more particularly, to a device for automatic horizontal positioning of a railway car coupler.

Description of Related Art

Railway cars include couplers for connecting adjacent cars to each other to form a train composition. Each coupler is adapted to swing within a predetermined angular range in a horizontal direction to facilitate car coupling and movement on a curved track. Adjoining car couplers are generally aligned to be on-center with the longitudinal axis of the railway car during a car coupling procedure. Due to variations in sizes of the cars and the type of coupler installed on each car, there may exist significant horizontal offsets between adjacent couplers in the lateral directions of the railway car. Such horizontal offsets are further compounded when attempting to couple adjacent railway cars on a curved section of a railway track. For instances in which coupling on a curved track is necessary, manual swing is typically required.

Existing couplers utilize pneumatically or hydraulically assisted coupler positioning devices capable of moving the car coupler within a predetermined angular range in a horizontal direction. Coupler alignment is achieved by a manual control input from an operator. Prior to the advent of hydraulic and pneumatic coupler positioning devices, coupler positioning was accomplished by spring centering elements having attachment points on the coupler head and the car body. The spring arrangement aligns the coupler with a longitudinal axis of the car to allow coupling on straight track sections. In order to connect adjacent cars on a curved track section, the springs are disconnected to allow the coupler on the first railway car to be manually moved into alignment with the coupler on an adjacent second railway car.

Several existing coupler positioning devices are known in the art. Each prior art coupler positioning device requires manual assistance while coupling on a curved section of the track. Some of the existing coupler positioning devices require a mechanical connection to the bogie, which is undesirable because it requires interfacing with the bogie and potentially induces large forces on the bogie during a collision that occurs when coupling cars. One such coupler positioning device is a pneumatic centering device that uses cylinders to ensure that the coupler is kept centered relative to a bogie and car body of a railway vehicle. The cylinders push against plates operatively connected to a coupler. By pushing on the plates, the coupler is kept in a centered position. If the coupler is moved in a horizontal plane towards one of the cylinders, that cylinder will push on one of the plates and push the coupler back into an on-center position. This coupler positioning device is not used to position the coupler in an off-center position. Likewise, another coupler positioning device keeps the coupler at a centered position at all times. This coupler positioning device includes cylinders are operatively connected to a rack and pinion system that moves laterally with regards to the coupler. Upon the coupler moving in one direction, an opposite cylinder pushes the rack and pinion system towards itself in order to place the coupler back in a centered position. Lastly, another coupler positioning device uses a traditional mechanical arrangement to keep the coupler centered relative to the body of the railway vehicle. In this coupler positioning device, springs are connected to the railway vehicle at one end and connected to the coupler at an opposing end. Upon the coupler moving to an off-center direction, a first spring is pulled in the off-center direction. Once the coupler stops moving, an opposing spring pulls the coupler back into a centered position. All of these coupler positioning devices are used to keep the coupler in a centered position to allow the coupler to couple to an adjacent coupler along a straight section of track. None of them contemplate moving and maintaining a coupler in an off-center position.

SUMMARY OF THE INVENTION

None of the positioning devices, discussed above, uses an automated means for positioning the coupler at an off-center position to allow the coupler to couple to an adjacent coupler on a curved section of track. Existing designs for coupler positioning devices are not adapted for automatically aligning couplers of adjacent railway cars. Conventional coupler positioning devices require a manual input from an operator in order to position adjacent couplers in alignment for coupling on curved track sections. Additionally, conventional coupler positioning devices can only center the coupler relative to a plane perpendicular to the mounting face for the coupler anchor. In view of the foregoing, a need exists for a coupler positioning device that automatically positions the coupler for automatic coupling based on input received from a controller. An additional need exists to provide a coupler positioning device that is automatically adjustable to align adjacent couplers on straight or curved tracks. A further need exists for an automated coupler positioning device that is self-contained. Manual disengagement of the automated coupler positioning device is optional for manual positioning during maintenance of the coupler.

In accordance with one embodiment, an automated coupler positioning device is provided to facilitate horizontal alignment of the coupler regardless of whether the railway our is positioned on a straight track or a curved track. The automated coupler positioning device includes a controller for controlling the coupler alignment in response to a signal received from the railway car and railway car bogie.

In accordance with another embodiment, the automated coupler positioning device is adapted for performing an automated positioning operation of the coupler relative to an adjacent coupler without requiring manual assistance. In another embodiment, the automated operation can be bypassed by disengaging the automated coupler positioning device at the coupler head without the use of any tools for manual alignment of the coupler that can easily be performed by a single operator.

In another embodiment, a coupler for a railway car may include a coupler anchor, a coupler mechanism pivotable relative to the coupler anchor from an on-center position to an off-center position in a substantially horizontal plane, and a coupler positioning device for pivoting the coupler mechanism relative to the coupler anchor. The coupler positioning device may include a controller adapted for receiving signal information from a bogie relating to an angular position of the bogie relative to a body of the railway car, and at least one pneumatic cylinder for pivoting the coupler mechanism. The controller may control the operation of the at least one pneumatic cylinder in response to the signal information received from the bogie.

The at least one pneumatic cylinder may include a first pneumatic cylinder and a second pneumatic cylinder. Each pneumatic cylinder may be controlled independently by the controller. A first end of the at least one pneumatic cylinder may be positioned on the coupler anchor and a second end of the at least one pneumatic cylinder may be positioned on the coupler mechanism. A cutout cock may be positioned on the coupler mechanism. The cutout cock may be configured to vent pressurized fluid from the at least one pneumatic cylinder to permit manual positioning of the coupler mechanism. A mechanical switch may be positioned on the coupler mechanism. The mechanical switch may be configured to detect when the coupler is coupled with an adjacent coupler. Upon activation of the mechanical switch, the at least one pneumatic cylinder may be isolated and pressurized fluid may be vented therefrom. The controller may include at least one magnet valve positioned in-line with at least one pressure transducer. The at least one pressure transducer may be configured to relay an electric signal to the controller based on the amount of pressure supplied to the at least one pneumatic cylinder. At least one linear transducer may be operatively connected to the controller and the at least one pneumatic cylinder. The at least one linear transducer may be configured to relay an electric signal to the controller based on the linear displacement of the at least one pneumatic cylinder.

In another embodiment, a railway car coupler for coupling railway cars may include a coupler anchor connected to a railway car body, a coupler mechanism pivotable relative to the coupler anchor from an on-center position to an off-center position in a substantially horizontal plane, and a coupler positioning device for centering the coupler mechanism relative to the coupler anchor. The coupler positioning device may include a controller adapted for receiving signal information from a bogie relating to an angular position of the bogie relative to the railway car body, and at least one pneumatic cylinder for pivoting the coupler mechanism. The controller may control the operation of the at least one pneumatic cylinder in response to the signal information received from the bogie.

The at least one pneumatic cylinder may include a first pneumatic cylinder and a second pneumatic cylinder. Each pneumatic cylinder may be controlled independently by the controller. A first end of the at least one pneumatic cylinder may be positioned on the coupler anchor and a second end of the at least one pneumatic cylinder may be positioned on the coupler mechanism. A cutout cock may be positioned on the coupler mechanism. The cutout cock may be configured to vent pressurized fluid from the at least one pneumatic cylinder to permit manual positioning of the coupler mechanism. A mechanical switch may be positioned on the coupler mechanism. The mechanical switch may be configured to detect when the coupler is coupled with an adjacent coupler. Upon activation of the mechanical switch, the at least one pneumatic cylinder may be isolated and pressurized fluid may be vented therefrom. The controller may include at least one magnet valve positioned in-line with at least one pressure transducer. The at least one pressure transducer may he configured to relay an electric signal to the controller based on the amount of pressure supplied to the at least one pneumatic cylinder. At least one linear transducer may be operatively connected to the controller and the at least one pneumatic cylinder. The at least one linear transducer may be configured to relay an electric signal to the controller based on the linear displacement of the at least one pneumatic cylinder.

In another embodiment, a method for the automated positioning of a railway car coupler may include the steps of measuring an angular position of a bogie relative to a body of a railway car, sending signal information relating to the angular position of the bogie to a controller, and adjusting pressure provided to at least one pneumatic cylinder operatively connected to a coupler based on the signal information received by the controller, thereby positioning the coupler in a desired position in a substantially horizontal plane. The at least one pneumatic cylinder may include a first pneumatic cylinder and a second pneumatic cylinder. The controller may be configured to adjust the pressure of each pneumatic cylinder independently of one another.

These and other features and characteristics of the automated coupler positioning device, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DESCRIPTION OF THE PREFERRED EMBODIMENTS

Figure 1:
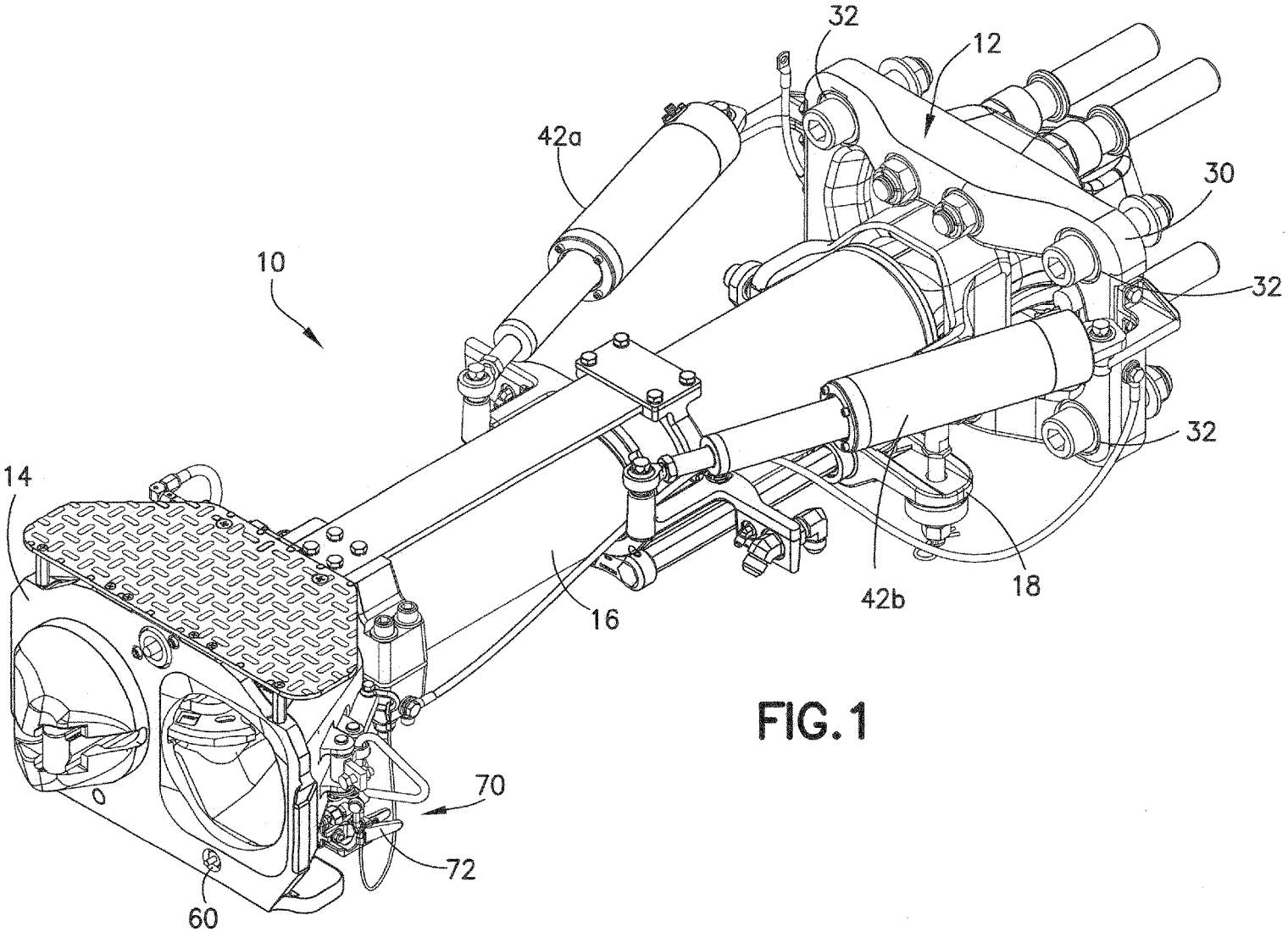
FIG. 1 is a front perspective view of an automated coupler positioning device in accordance with one embodiment.
Figure 2:
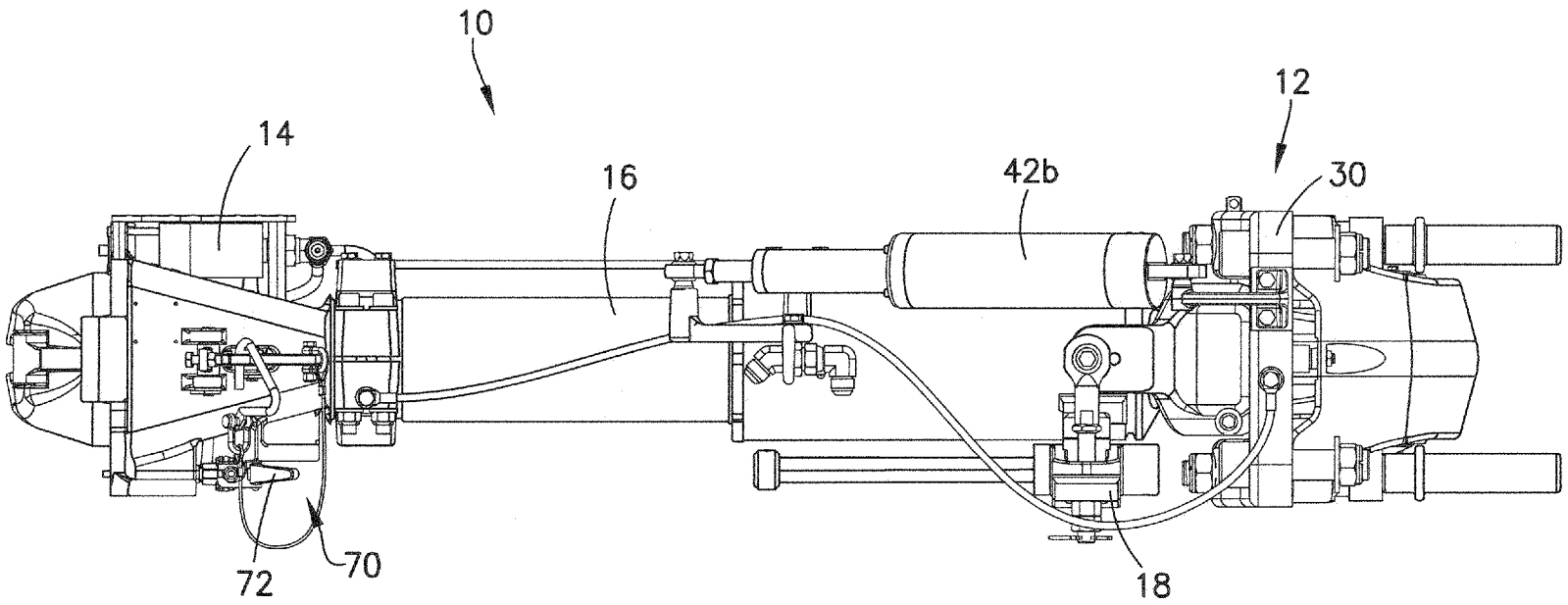
FIG. 2 is a side view of the automated coupler positioning device of FIG. 1.
Figure 3:
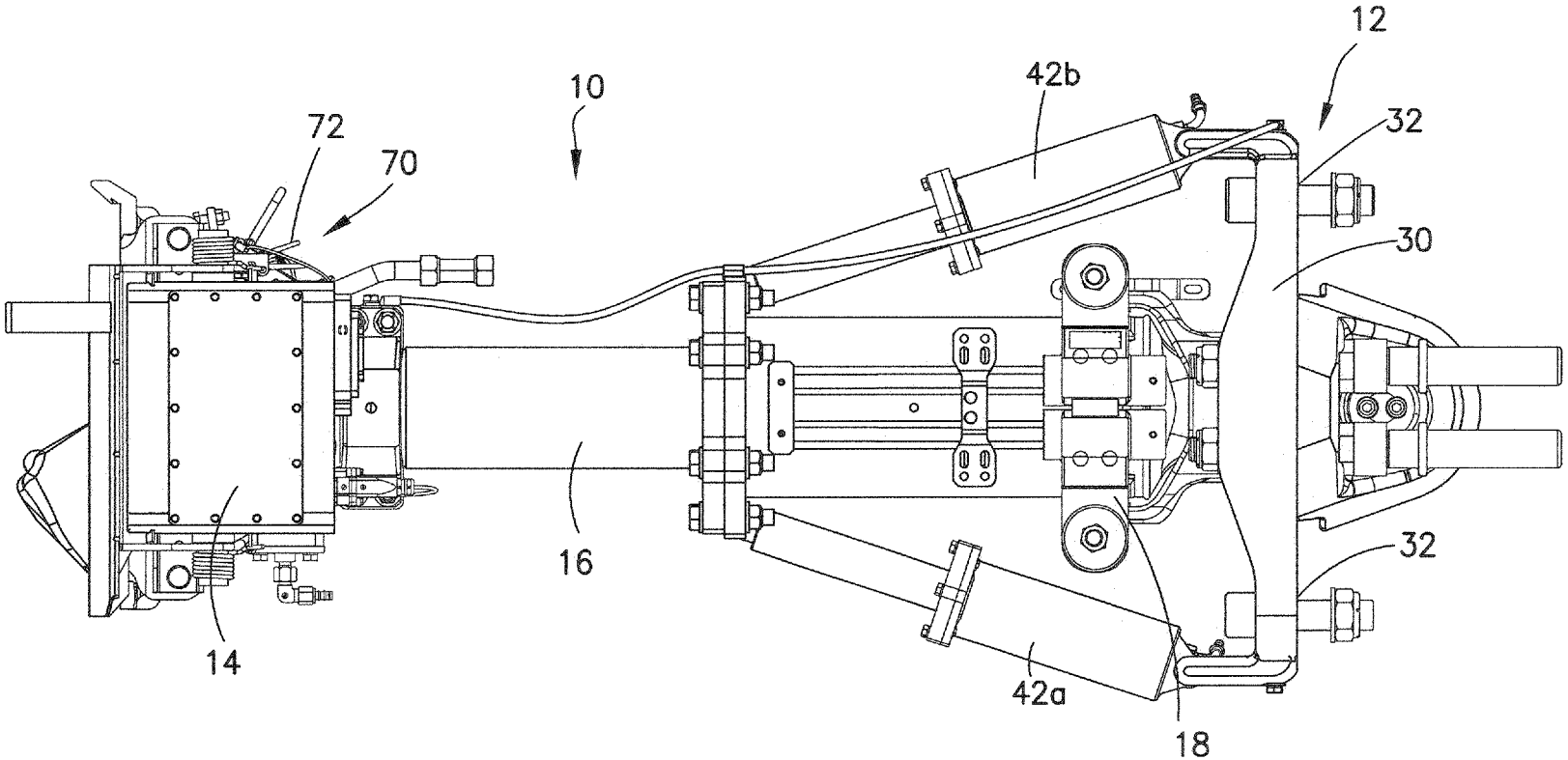
FIG. 3 is a bottom view of the automated coupler positioning device of FIG. 1.
Figure 4:
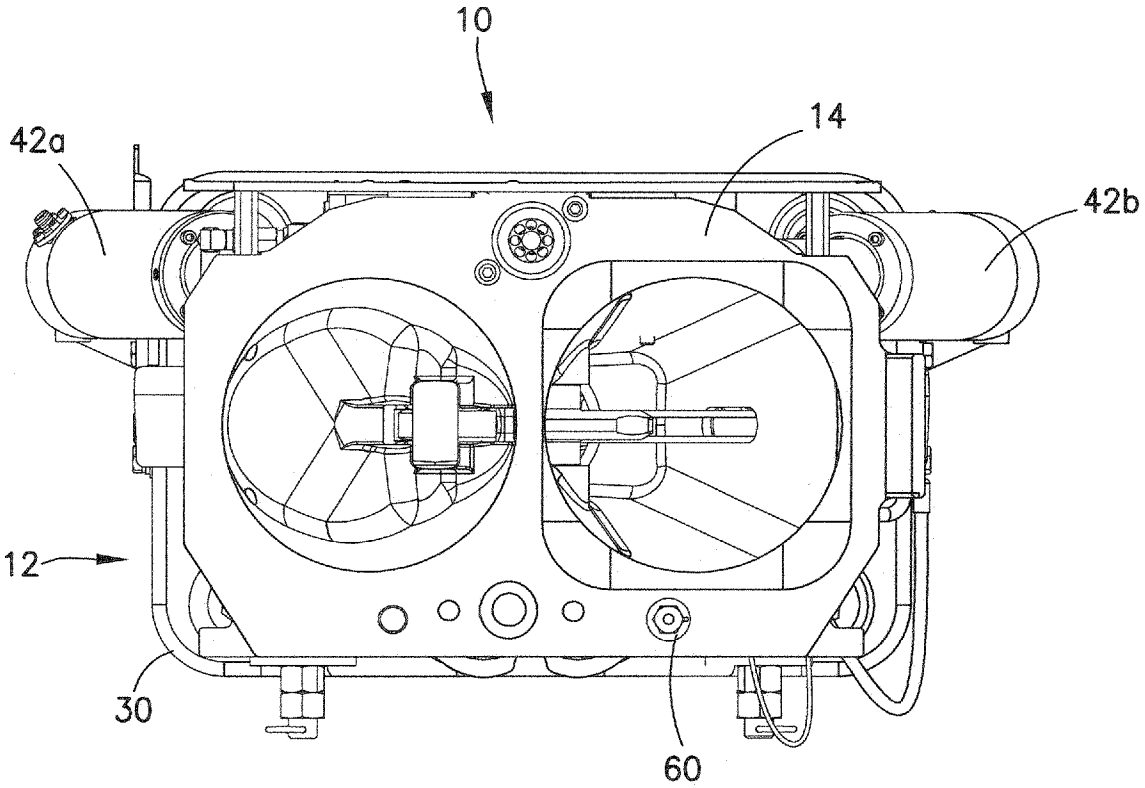
FIG. 4 is a front view of the automated coupler positioning device of FIG. 1.
Figure 5:
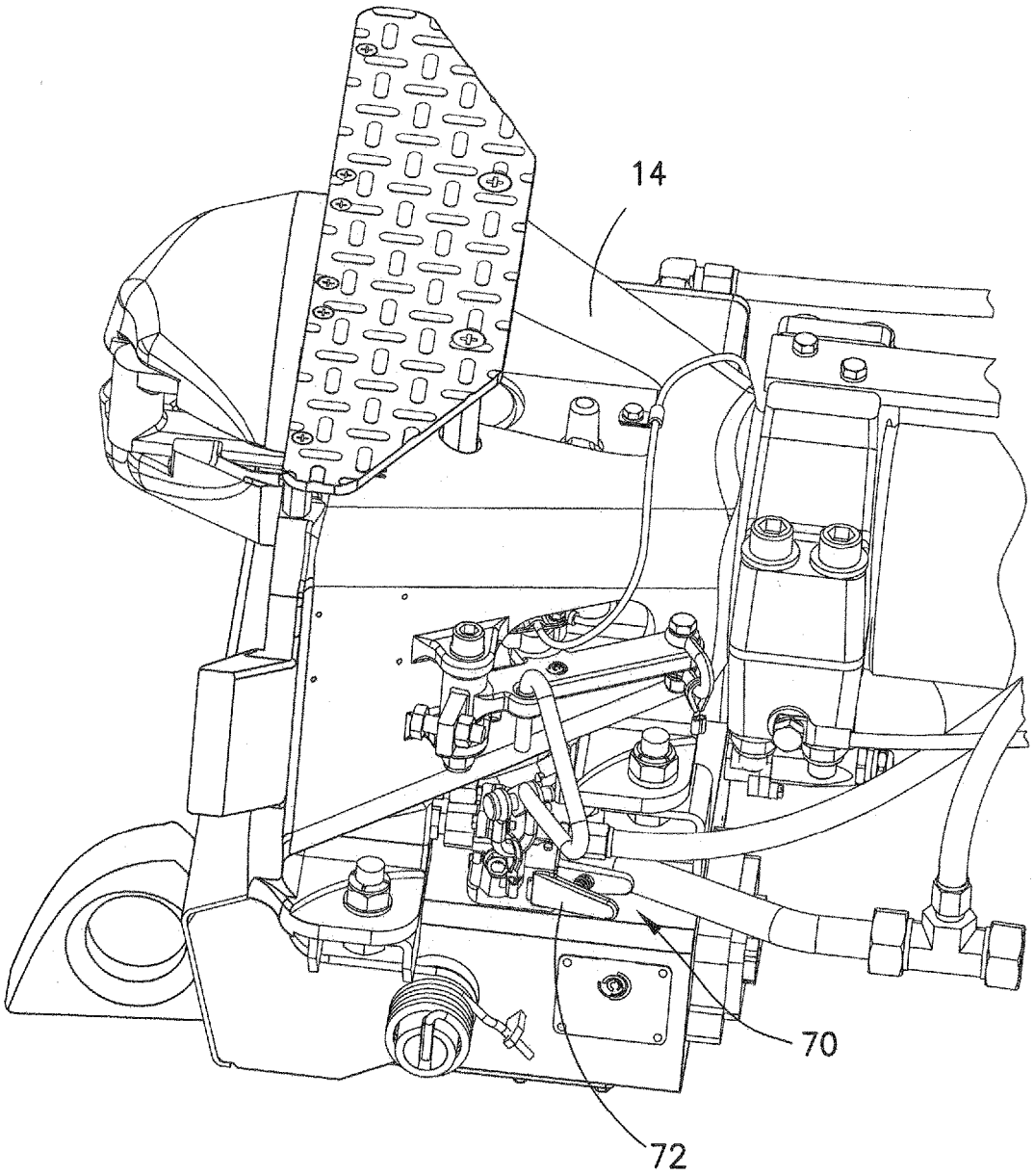
FIG. 5 is a perspective side view of a cutout cock valve of the automated coupler positioning device of FIG. 1.

For purposes of the description hereinafter, the terms "upper", "lower", "right", "left", "vertical", "horizontal", "top", "bottom", "lateral", "longitudinal", and derivatives thereof, shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Referring to the drawings in which like reference characters refer to like parts throughout the several views thereof, the present disclosure is generally directed to a railway car coupler having an automated coupler positioning device for adjusting the alignment of the coupler in a horizontal plane in lateral directions of the railway car.

Referring initially to FIGS. 1-5, an embodiment of a coupler 10 is shown. Coupler 10, as described herein, is intended for connection to a frame of a railway car (not shown), as will be readily apparent to those skilled in the rail vehicle art. Coupler 10 is adapted for use in railway vehicles used for passenger and/or cargo transit. However, this use is intended to be non-limiting and coupler 10 has applications in railway cars generally. Coupler 10 in the depicted embodiment generally includes a coupler anchor 12, a coupler mechanism 14, a regenerative capsule 16, and a vertical support 18. A coupler head (not shown) is coupled to the coupler mechanism 14 for connecting a railway car to an adjacent railway car. Regenerative capsule 16 connects coupler mechanism 14 to coupler anchor 12 by connection with vertical support 18.

Figure 10:
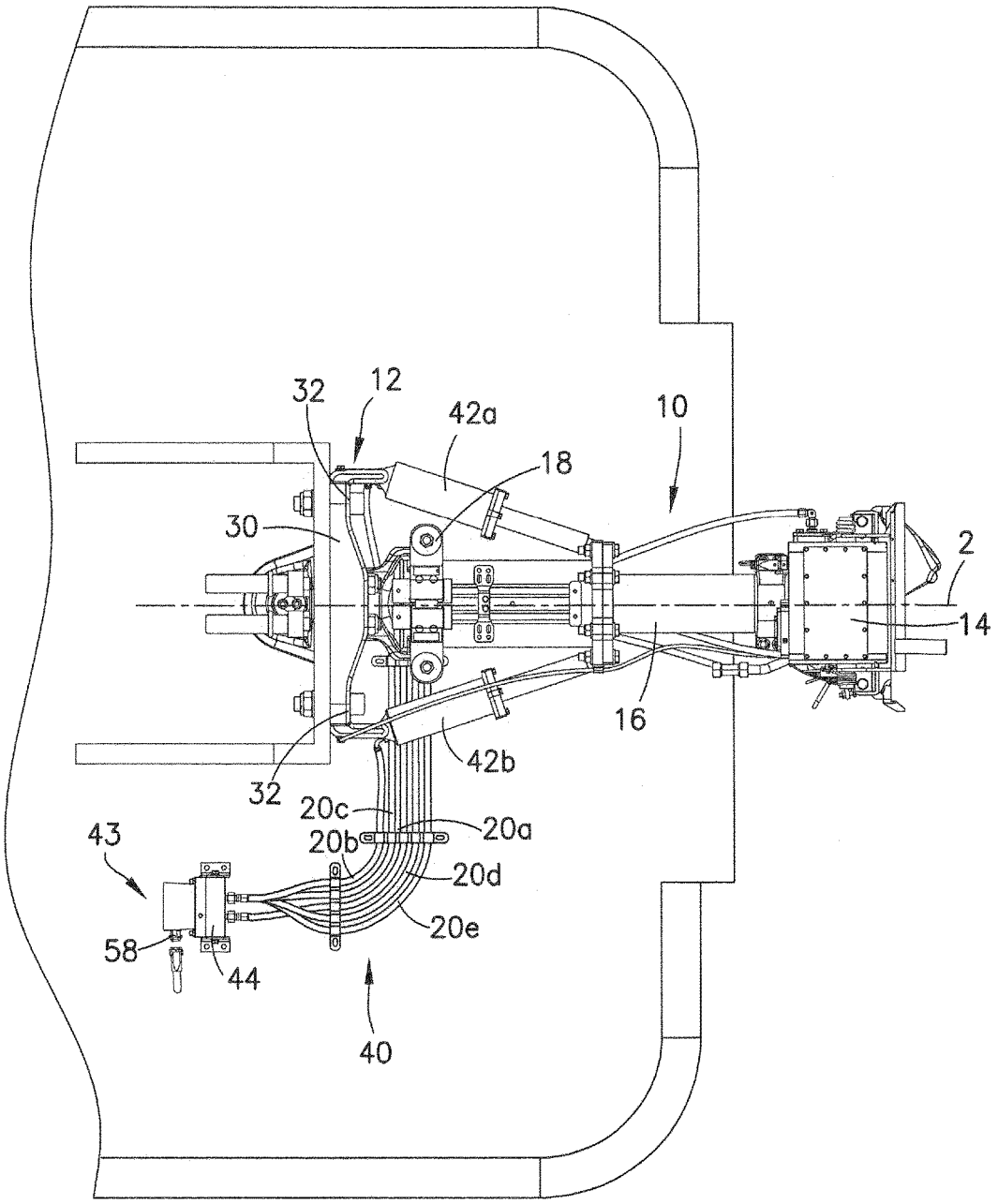
FIG. 10 is a bottom view of the automated coupler positioning device of FIG. 1 in an on-center position.
Figure 11:
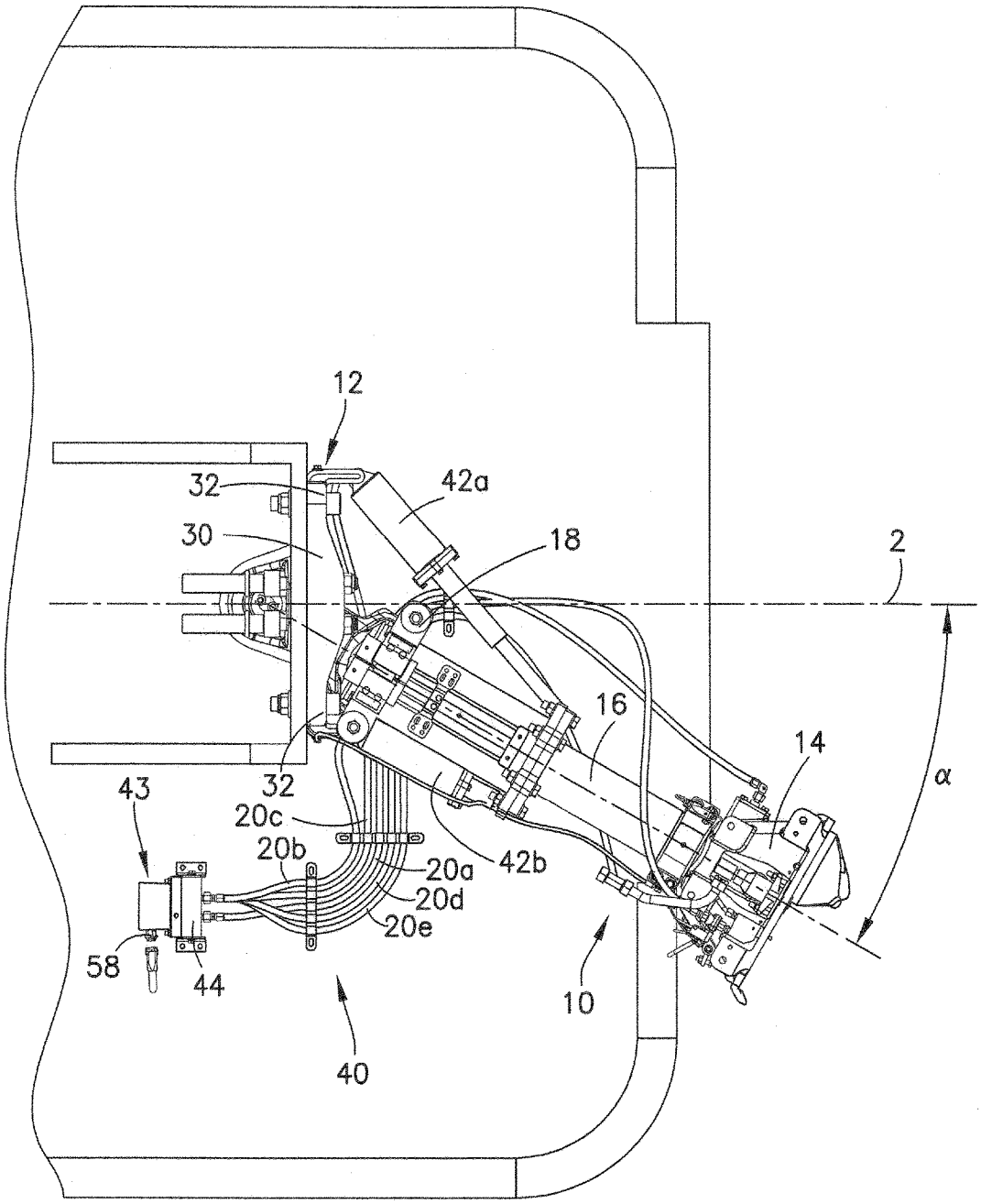
FIG. 11 is a bottom view of the automated coupler positioning device of FIG. 1 in an off-center position.

Coupler anchor 12 has a substantially rectangular-shaped anchor body 30 that is truncated from its lateral sides. A front face of anchor body 30 defines a plurality of anchor mounting apertures 32 which accept securing elements (not shown) for interfacing with and securing anchor body 30 to the car frame of the railway car. Anchor body 30 pivotally supports coupler mechanism 14, regenerative capsule 16, and vertical support 18. Coupler mechanism 14, regenerative capsule 16, and vertical support 18 are pivotable in a horizontal plane in either direction from a longitudinal axis 2 of the railway car. Coupler mechanism 14, regenerative capsule 16, and vertical support 18 may pivot through a predetermined angular range from an on-center position that is substantially parallel with longitudinal axis 2. As shown in FIGS. 10 and 11, coupler mechanism 14, regenerative capsule 16, and vertical support 18 may remain at an on-center position along longitudinal axis 2 (FIG. 10) or pivot to an off-center position at an angle $\alpha$ away from longitudinal axis 2 (FIG. 11). One of ordinary skill in the art will appreciate that angle $\alpha$ is exemplary only and that coupler mechanism 14, regenerative capsule 16, and vertical support 18 may be pivoted to any angular position offset from the on-center position on either lateral side of longitudinal axis 2.

Figure 6:
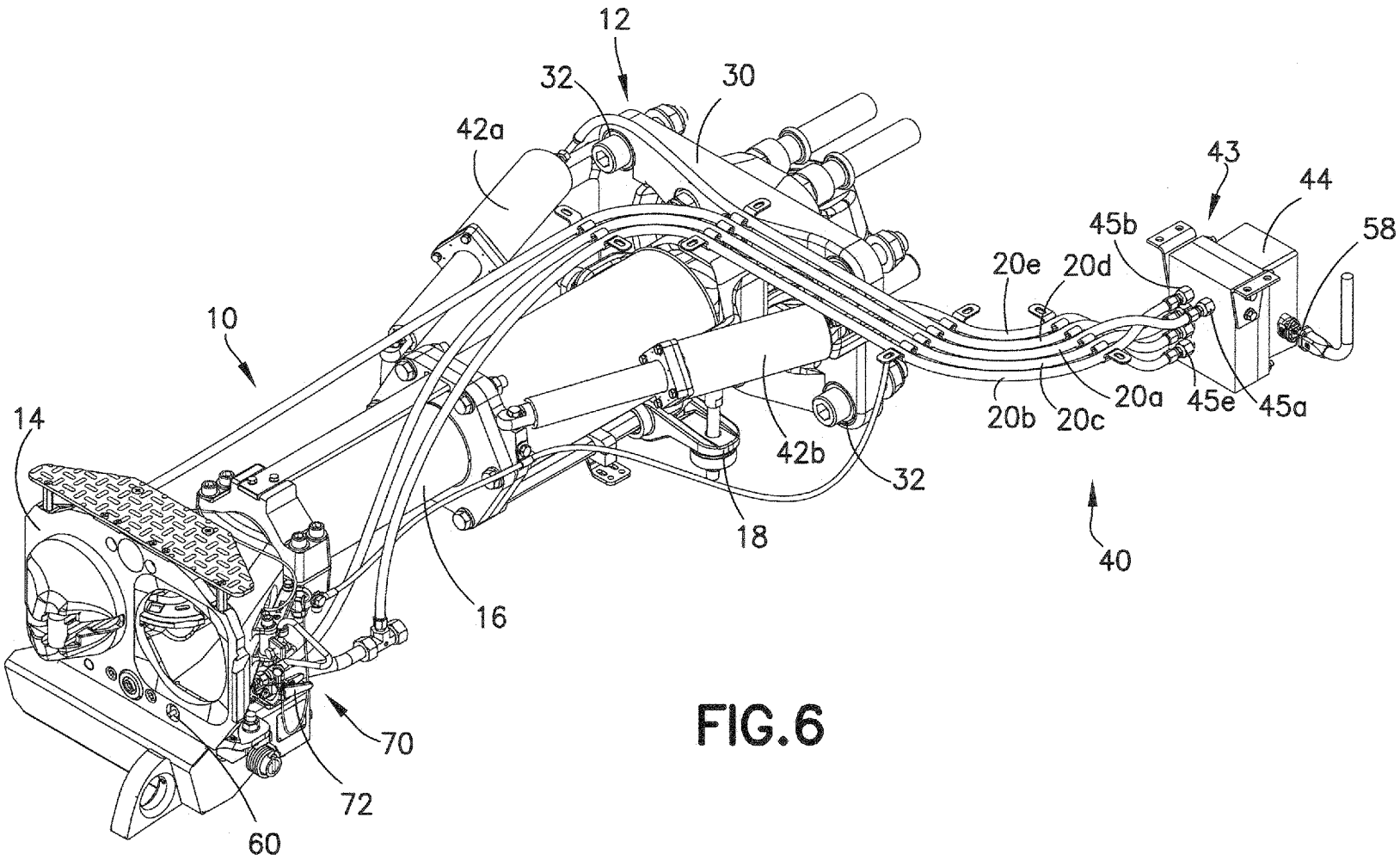
FIG. 6 is a front perspective view of the automated coupler positioning device of FIG. 1 along with a controller for the automated coupler positioning device.
Figure 7:
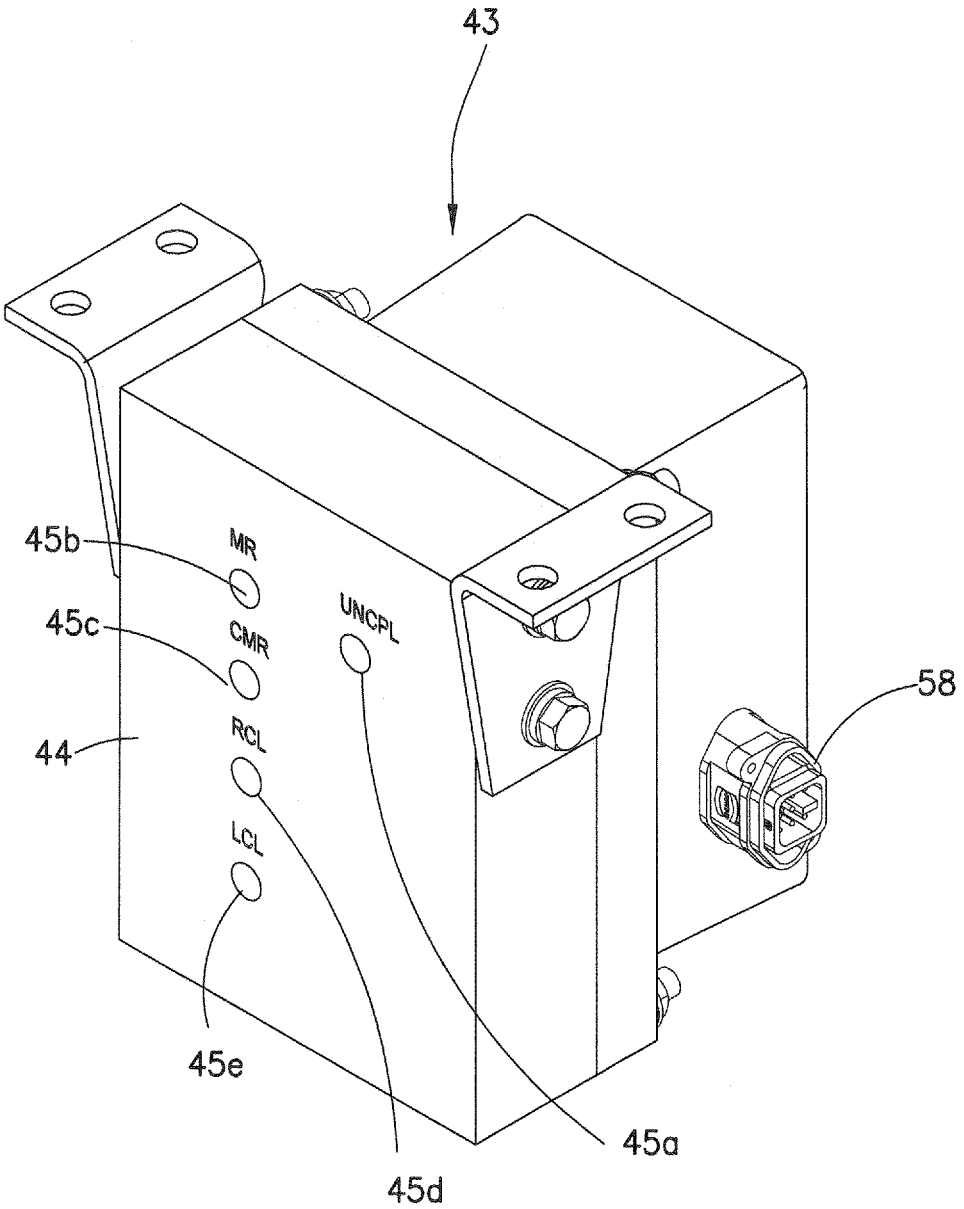
FIG. 7 is a front perspective view of the controller of FIG. 6.
Figure 8:
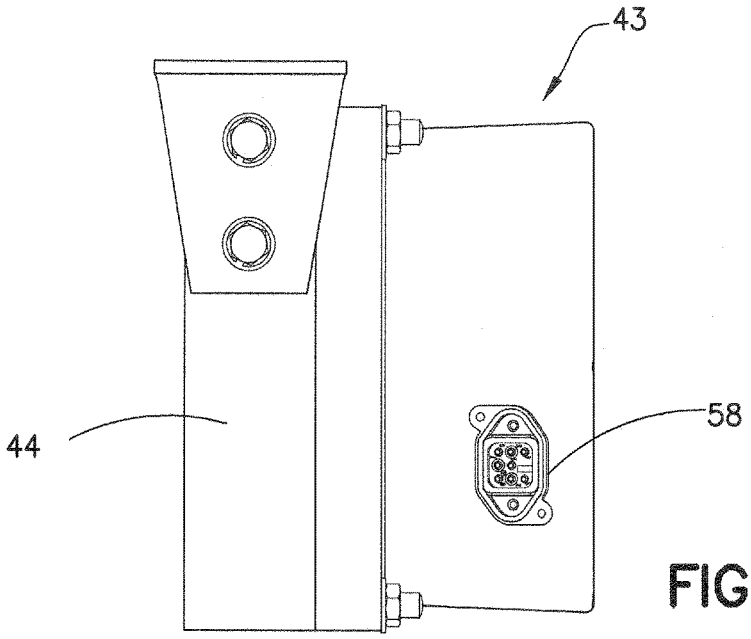
FIG. 8 is a side view of the controller of FIG. 6.
Figure 9:
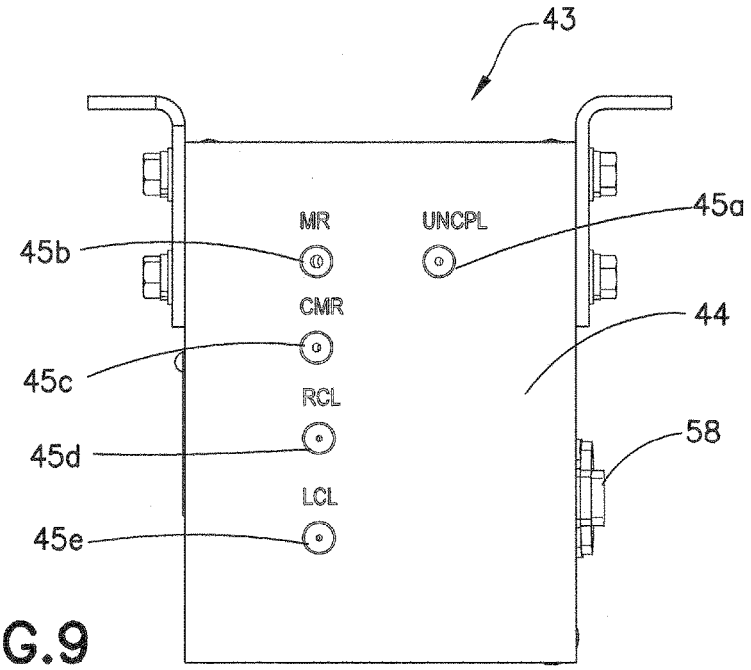
FIG. 9 is a back view of the controller of FIG. 6.

With reference to FIG. 6, coupler 10 further includes an automated coupler positioning device 40 for aligning the coupler of a first railway car for coupling with a coupler of an adjacent railway car. Automated coupler positioning device 40 is operative for automatically aligning the coupler to facilitate coupling of adjacent railway cars on straight or curved track sections without requiring any manual input.

With reference to FIGS. 6-9, automated coupler positioning device 40 includes a pair of pneumatic cylinders 42*a*, 42*b* and a controller 43 to automatically horizontally position an uncoupled coupler based on an input signal from the car body and car bogie. Each pneumatic cylinder 42*a*, 42*b* is connected to coupler anchor 12 or the body of the railway car at one end, and to the coupler 10 at the opposing end. FIG. 6 illustrates pneumatic cylinders 42*a*, 42*b* connected at an approximate midpoint of the longitudinal length of coupler 10. In another embodiment, pneumatic cylinders 42*a*, 42*b* may be connected closer or farther from the terminal end of coupler 10. Each pneumatic cylinder 42*a*, 42*b* includes a piston that is movable longitudinally in response to the change in pressure within the cylinder. An increase in pressure within pneumatic cylinder 42*a*, 42*b* causes the piston to extend away from the cylinder, and a decrease in pressure within pneumatic cylinder 42*a*, 42*b* causes the piston to withdraw into the cylinder. Pneumatic cylinders 42*a*, 42*b* receive pressurized air from the pneumatic system of the railway car. Pneumatic hoses 20*a*, 20*b*, 20*c*, 20*d*, 20*e* may be used to provide pressurized fluid to the pneumatic system of the railway car.

In one embodiment, controller 43 regulates the operation of each pneumatic cylinder 42*a*, 42*b* independently. Controller 43 receives signals from the bogie of the railway vehicle to control the operation of pneumatic cylinders 42*a*, 42*b* in response to the received signal. Controller 43 controls the operation of pneumatic cylinders 42*a*, 42*b* by pressurizing the cylinders to cause the piston to extend from the cylinder, or depressurizing the cylinders to cause the piston to withdraw into the cylinder.

Figure 12A:
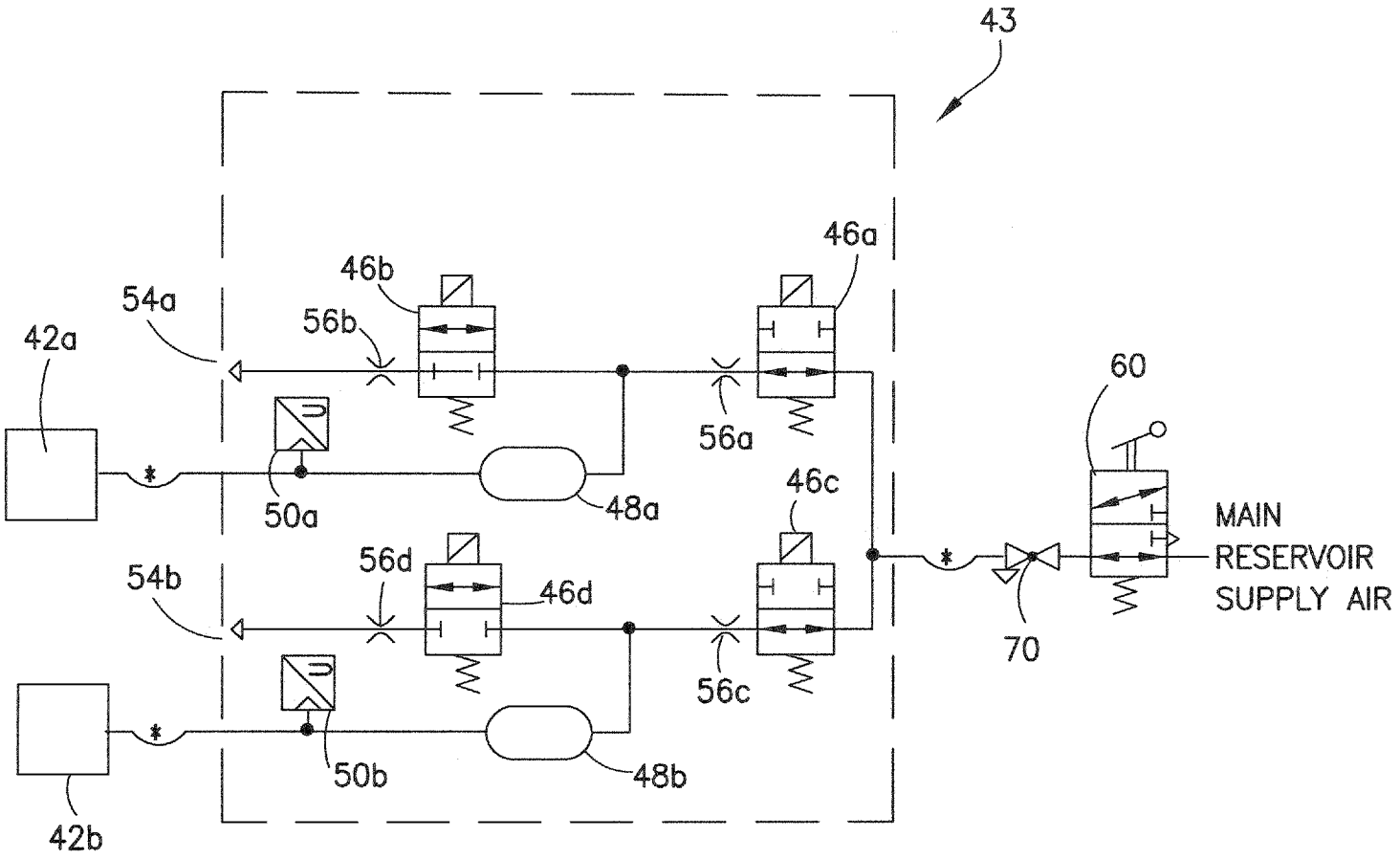
FIGS. 12A and 12B are schematic views of a controller adapted for use with an automated coupler positioning device.
Figure 12B:
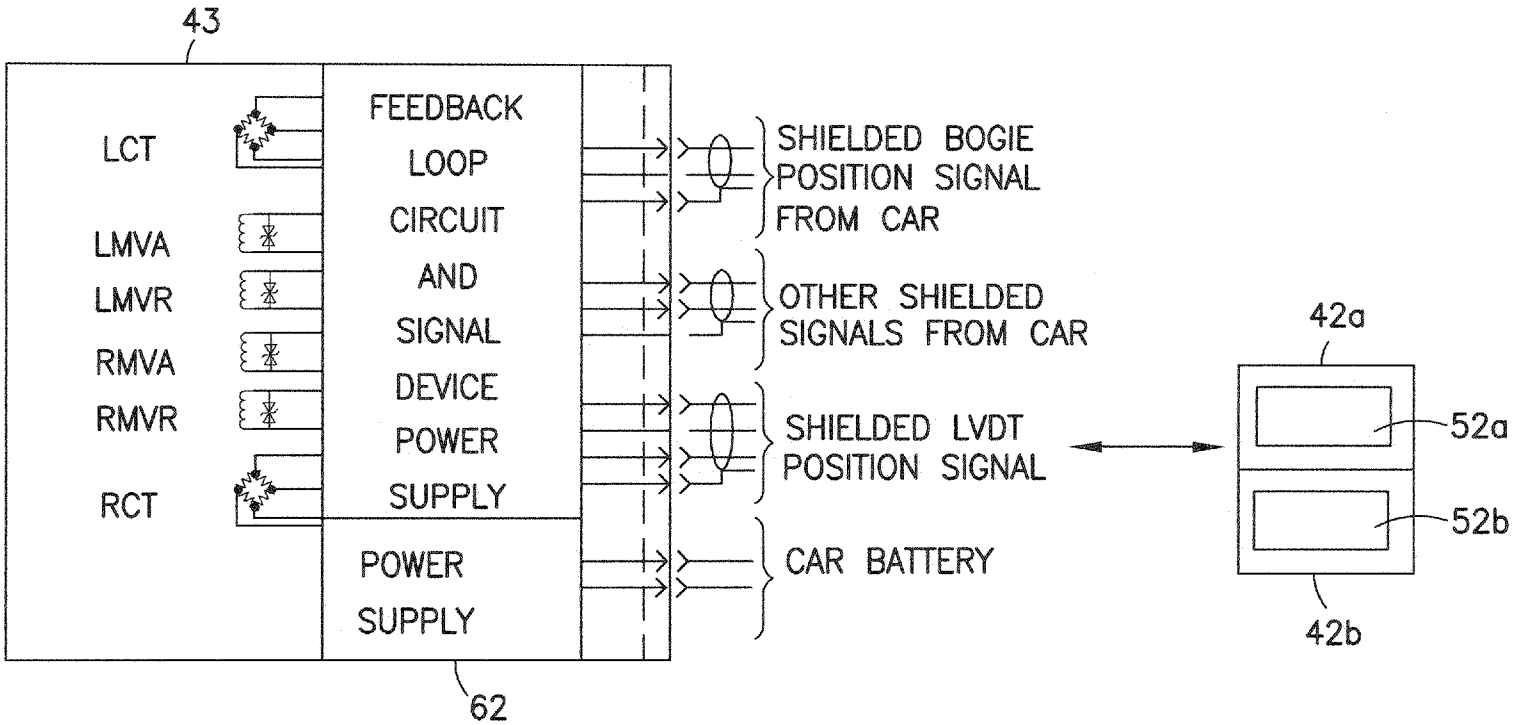

Controller 43 is shown in more detail in FIGS. 12A and 12B. A discussion of the operation of controller 43 is discussed hereinbelow. Controller 43 includes housing 44, which holds the components of controller 43. A plurality of pneumatic hose input channels 45*a*, 45*b*, 45*c*, 45*d*, 45*e* are defined in housing 44 of controller 43. Input channels 45*a*, 45*b*, 45*c*, 45*d*, 45*e* are adapted to receive an end of each pneumatic hose 20*a*, 20*b*, 20*c*, 20*d*, 20*e*. A plurality of magnet valves 46*a*, 46*b*, 46*c*, 46*d* are used in controller 43 to direct pressurized air to the desired pneumatic cylinder 42*a*, 42*b* via pneumatic hoses 20*a*, 20*b*, 20*c*, 20*d*, 20*e*, Each magnet valve 46*a*, 46*b*, 46*c*, 46*d* is configured with an open position and a closed position. In one embodiment, two magnet valves 46*a*, 46*b* are operatively connected to one pneumatic cylinder 42*a*, and two additional magnet valves 46*c*, 46*d* are operatively connected to another pneumatic cylinder 42*b*. It is to be understood, however, that one of ordinary skill in the art will appreciate that more magnet valves may be used in controller 43 or less magnet valves may be used in controller 43. It is also to be understood that different arrangements of the magnet valves 46*a*, 46*b*, 46*c*, 46*d* are contemplated as well. A reservoir 48*a*, 48*b* is positioned in-line with each pneumatic cylinder 42*a*, 42*b*. Reservoirs 48*a*, 48*b* may hold any excess pressurized air that is oversupplied to pneumatic cylinders 42*a*, 42*b* and/or may hold an extra supply of pressurized air to compensate for any leaks that develop within controller 43 or pneumatic cylinders 42*a*, 42*b*.

In one embodiment, pressure transducers 50*a*, 50*b* may be positioned in-line with pneumatic cylinders 42*a*, 42*b*. Based on the pressure being applied, the pressure transducers 50*a*, 50*b* may send an electric signal to controller 43 relaying the amount of pressurized air being supplied to pneumatic cylinders 42*a*, 42*b*. In another embodiment, linear transducers 52*a*, 52*b* may be used with automated coupler positioning device 40. Linear transducers 52*a*, 52*b* may be positioned on pneumatic cylinders 42*a*, 42*b*. Linear transducers 52*a*, 52*b* may be used to send an electric signal to controller 43 to report the distance each pneumatic cylinder 42*a*, 42*b* has either extended or withdrawn based on the pressure supplied to pneumatic cylinders 42*a*, 42*b*. Linear transducers are preferred for use with automated coupler positioning device 40 as linear transducers provide a more accurate measurement as compared to pressure transducers. In yet another embodiment, pressure transducers 50*a*, 50*b* and linear transducers 52*a*, 52*b* may be used together to send electric signals to controller 43 to report the amount of pressure supplied to pneumatic cylinders 42*a*, 42*b* and the distance pneumatic cylinders 42*a*, 42*b* have either extended or retracted due to the pressure supplied to pneumatic cylinders 42*a*, 42*b*. By using both pressure transducers 50*a*, 50*b* and linear transducers 52*a*, 52*b*, a failsafe configuration is created. In this embodiment, if pressure transducers 50*a*, 50*b* were to fail due to a faulty connection, wear, or disconnection from controller 43, linear transducers 52*a*, 52*b* would still able be to send an electric signal to controller 43 to report the distance pneumatic cylinders 42*a*, 42*b* have either extended or retracted. Similarly, if linear transducers 52*a*, 52*b* were to fail, pressure transducers 50*a*, 50*b* would still be available to send an electric signal to controller 43. While the use of pressure transducers and linear transducers has been discussed, it is to be understood that additional types of transducers may be used with controller 43, such as electrical, mechanical, or thermal transducers, among others.

Exhaust ports 54*a*, 54*b* are defined in housing 44 of controller 43 and may be used to vent excess pressurized air from controller 43. At least one choke 56*a*, 56*b*, 56*c*, 56*d* provide in controller 43 may be used to reduce the flow of pressurized air through controller 43. In one embodiment, chokes 56*a*, 56*b*, 56*c*, 56*d* are positioned behind magnet valves 46*a*, 46*b*, 46*c*, 46*d*, respectively. Housing 44 of controller 43 also includes bogie input signal port 58 that is used to receive a signal from the bogie relaying the angular orientation of the railway car and railway car bogie.

As depicted in the schematic of FIG. 12B, controller 43 includes a feedback loop circuit and signal device power supply. The feedback loop circuit and signal device power supply receives signals from the bogie and, in one embodiment of the disclosure, linear transducers 52*a*, 52*b*. In the schematic, linear transducers 52*a*, 52*b* are coupled with pneumatic cylinders 42*a*, 42*b*, respectively. Other signals from the railway car are also sent to the feedback loop circuit and signal device power supply. Left cylinder pressure transducer 42*b* (LCT) and right cylinder pressure transducer 42*a* (RCT) are shown in communication with the feedback loop circuit and signal device power supply. A left magnet valve apply (LMVA) and a right magnet valve apply (RMVA) are in communication with the feedback loop circuit and signal device as well. Also in communication with the feedback loop circuit and signal device is a left magnet valve release (LMVR) and a right magnet valve release (RMVR). Power supply 62 of controller 43 is supplied via, in one embodiment of the disclosure, a car battery. It is to be understood, however, that any other suitable power source may be used in place of the car battery.

After adjacent couplers have coupled, it is often desirable that the couplers be free to move without resistance from automated coupler positioning device 40. By supplying pressurized air to the couplers after being coupled, the couplers may remain rigid and unable to move side to side relative to a curve in the track. Therefore, it is important to ensure that the couplers are not held rigid, but instead are permitted to move freely to navigate any curves in the track. Upon coupling, mechanical switch 60 on the coupler mechanism 14 detects when the coupler has coupled with an adjacent coupler and responds to this input by isolating or shutting off the pressurized air to pneumatic cylinders 42*a*, 42*b*. The pressurized fluid in pneumatic cylinders 42*a*, 42*b* is vented. This allows the coupled couplers to pivot freely during movement of the train without resistance from automated coupler positioning device 40.

It may also be desirable to enable manual movement of coupler 10 by bypassing the operation of automated coupler positioning mechanism 40. Such operation is particularly advantageous during maintenance of coupler 10. To facilitate such operation, automated coupler positioning device 40 is equipped with a cutout cock 70 located on the coupler mechanism 14 that may be used to isolate and vent all pneumatic air pressure from pneumatic cylinders 42*a*, 42*b* so that manual positioning of coupler 10 can still be performed. Cutout cock 70 includes lever 72, which may be activated by an operator to open cutout cock 70. Upon the opening of cutout cock 70, pressurized fluid is vented to atmosphere. It is to be understood that alternative types of valves may be used to shut off and vent the pneumatic air pressure from pneumatic cylinders 42*a*, 42*b*.

A method of using an automated coupler positioning device to couple adjacent couplers is described hereinbelow. As previously discussed, by using automated coupler positioning device 40, coupler 10 may be centered at an on-center orientation for coupling to an adjacent coupler on a straight section of the track, or at an off-center orientation for coupling to an adjacent coupler on a curved section of the track. With reference to FIG. 10, coupler 10 is shown in an on-center orientation for coupling to an adjacent coupler on a straight section of the track, while FIG. 11 illustrates coupler 10 in an off-center orientation for coupling on a curved section of the track.

During use of this method, controller 43 receives a signal relating to an angular orientation of the bogie relative to the body of the railway car. The angular orientation of the bogie relative to the body is directly correlative to the curvature of the track where the bogie is positioned. For example, on a straight track section, the bogie is substantially aligned relative to the car body such that an axis extending through the axle of the bogie is substantially perpendicular to an axis extending along the longitudinal length of the railway car. This embodiment is shown in FIG. 10. When the railway car is positioned on a curved track, such as shown in FIG. 11, the bogie is turned in the direction of the track such that the angle of the axis extending through the axle of the bogie is not substantially perpendicular to the axis extending along the longitudinal length of the railway car.

Controller 43 receives a signal from the bogie relating to the angular position of the bogie in order to control the operation of pneumatic cylinders 42*a*, 42*b*, for moving coupler 10 left and right in a horizontal plane. The angular orientation of coupler 10 due to the operation of automated coupler positioning device 40 is a function of the angular orientation of the bogie relative to the longitudinal axis of the car body. In one embodiment, the angular orientation of coupler 10 is the same as the angular orientation of the bogie relative to the longitudinal axis of the car body. In another embodiment, the angular orientation of coupler 10 is different from the angular orientation of the bogie relative to the longitudinal axis of the car body.

Because controller 43 controls the operation of each pneumatic cylinder 42*a*, 42*b* independently, the coupler can be aligned in left and right directions in the horizontal plane by increasing the pressure in one cylinder and decreasing the pressure in the other cylinder. This causes the piston from the cylinder with the increased pressure to extend and the piston from the cylinder with the reduced pressure to withdraw. Such operation of pneumatic cylinders 42*a*, 42*b* causes coupler 10 to be "pushed" by the piston from the cylinder with the increased pressure, while the piston from the cylinder with the reduced pressure is withdrawn. This causes coupler 10 to swing from the on-center state shown in FIG. 10 to an off-center state shown in FIG. 11. Automated coupler positioning device 40 automatically aligns the adjacent couplers to a correct angular orientation within the gathering range such that the adjacent railway cars can be coupled without any manual adjustment of the angular orientation of the couplers.

With reference to FIGS. 11, 12A and 12B, upon controller 43 receiving a signal relating to the angular orientation of the bogie, an electric signal is sent to at least one of magnet valves 46*a*, 46*b*, 46*c*, 46*d*. In one embodiment, magnet valves 46*a*, 46*c* are always oriented in an open position. During use of this embodiment, if the angular orientation of coupler 10 is positioned off-center towards pneumatic cylinder 42*b* and the operator wishes to move coupler 10 back to an on-center position, an electric signal is sent to magnet valve 46*a* to move the magnet valve 46*a* to a closed position. Simultaneously, an electric signal is sent to magnet valve 46*b* to move magnet valve 46*b* to an open position. The pressurized air in pneumatic cylinder 42*a* is thereby vented through exhaust port 54*a*. No signal is sent to magnet valves 46*c* and 46*d* keeping magnet valve 46*c* in an open position and magnet valve 46*d* in a closed position. Additional pressurized fluid may be supplied to pneumatic cylinder 42*b* to push coupler 10 back into an on-center position. By using this method, the coupler 10 is moved towards pneumatic cylinder 42*a*, the pneumatic cylinder with the lower pressure, and into an on-center position. This same method may be used if coupler 10 is positioned off-center and towards pneumatic cylinder 42*a*. In this instance, an electric signal is simultaneously sent to magnet valve 46*c* to position magnet valve 46*c* in a closed position and to magnet valve 46*d* to position magnet valve 46*d* in an open position, thereby allowing pressurized air to exhaust via exhaust port 54*b*. This method may also be used when coupler 10 is positioned at an on-center position and an operator wishes to reposition coupler 10 to an off-center position. An additional method of re-orienting coupler 10 from an off-center position to an on-center position is to fully pressurize both pneumatic cylinders 42*a* and 42*b*, which will push coupler 10 into an on-center position. Using this method, magnet valves 46*a* and 46*c* are both set in an open position, and magnet valves 46*b* and 46*d* are both set in a closed position. Therefore, all pressurized fluid is directed to pneumatic cylinders 42*a* and 42*b*, pushing coupler 10 into an on-center position.

It is also contemplated that magnet valves 46*a*, 46*c* may always be oriented in a closed position. In this situation, in order to provide pressurized air to pneumatic cylinder 42*a*, an electric signal is sent to magnet valve 46*a* to move magnet valve 46*a* to an open position. By opening magnet valve 46*a*, pressurized air may be directed to pneumatic cylinder 42*a*. Similarly, in order to provide pressurized air to pneumatic cylinder 42*b*, an electric signal is sent to magnet valve 46*c* to move magnet valve 46*c* to an open position. By opening magnet valve 46*c*, pressurized air may be directed to pneumatic cylinder 42*b*.

As pressurized air is supplied through magnet valves 46*a*, 46*c*, reservoirs 48*a*, 48*b* may also be filled with the pressurized air. This reservoir may be used to supply the pressurized air to pneumatic cylinders 42*a*, 42*b* and may be used to hold extra pressurized air to be used in the event of a leak in controller 43 or pneumatic cylinders 42*a*, 42*b*. It is also contemplated that reservoirs 48*a*, 48*b* may not be used with controller 43. In this instance, pressurized air is supplied directly to pneumatic cylinders 42*a*, 42*b* without passing through a reservoir.

Magnet valves 46*b*, 46*d* are also used in controller 43 to vent any excess pressurized air through exhaust ports 54*a*, 54*b*. An electric signal can be sent to magnet valves 46*b*,46*d* to switch the valves between an open position and a closed position. When magnet valves 46*b*, 46*d* are arranged in a closed position, any pressurized air directed through magnet valves 46*a*, 46*c*, respectively, is directed entirely to pneumatic cylinders 42*a*, 42*b*. However, upon magnet valves 46*b*, 46*d* being arranged in an open position, the pressurized air supplied through magnet valves 46*a*, 46*c* is directed through the path of least resistance. In some instances, all of the pressurized air may flow to pneumatic cylinders 42*a*, 42*b*. In other instances, since reservoirs 48*a*, 48*b* are filled, the pressurized air may pass through magnet valves 46*b*, 46*d* and vent to atmosphere through exhaust ports 54*a*, 54*b* defined in housing 44 of controller 43.

Pressure transducers 50*a*, 50*b* may be used to send an electric signal to controller 43 to report how much pressure is being supplied to pneumatic cylinders 42*a*, 42*b*. By supplying this electric signal to controller 43, each pneumatic cylinder 42*a*, 42*b* can be independently adjusted according to the amount of pressure that is presently being supplied to each pneumatic cylinder 42*a*, 42*b*. Likewise, linear transducers 52*a*, 52*b* may be used to send an electric signal to controller 43 to report the linear distance that each pneumatic cylinder 42*a*, 42*b* has either extended or retracted. This also helps with positioning each pneumatic cylinder 42*a*, 42*b* independently to achieve the desired off-center position or on-center position. Pressure transducers 50*a*, 50*b* and linear transducers 52*a*, 52*b* may also be used together to supply information to controller 43. By using this arrangement, if one type of transducer were to fail, the remaining transducers may still be used to send electric signals to controller 43 to report the position of pneumatic cylinders 42*a*, 42*b*, While various embodiments of automated coupler positioning device 40 were provided in the foregoing description, those skilled in the art may make modifications and alterations to these embodiments without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A coupler for a railway car, comprising:

a coupler anchor;

a coupler mechanism pivotable relative to the coupler anchor from an on-center position to an off-center position in a substantially horizontal plane; and a coupler positioning device for pivoting the coupler mechanism relative to the coupler anchor, the coupler positioning device comprising:

a controller adapted for receiving signal information from a bogie directed to a measured angular position of the bogie relative to a body of the railway car; and at least one pneumatic cylinder for pivoting the coupler mechanism, wherein the controller controls the operation of the at least one pneumatic cylinder in response to the signal information received from the bogie.

2. The coupler as claimed in claim 1, wherein the at least one pneumatic cylinder comprises a first pneumatic cylinder and a second pneumatic cylinder.

3. The coupler as claimed in claim 2, wherein each pneumatic cylinder is controlled independently by the controller.

4. The coupler as claimed in claim 1, wherein a first end of the at least one pneumatic cylinder is positioned on the coupler anchor and a second end of the at least one pneumatic cylinder is positioned on the coupler mechanism.

5. The coupler as claimed in claim 1, further comprising a cutout cock positioned on the coupler mechanism, wherein the cutout cock is configured to vent pressurized fluid from the at least one pneumatic cylinder to permit manual positioning of the coupler mechanism.

6. The coupler as claimed in claim 1, further comprising a mechanical switch positioned on the coupler mechanism, wherein the mechanical switch is configured to detect when the coupler is coupled with an adjacent coupler, and wherein, upon activation of the mechanical switch, the at least one pneumatic cylinder is isolated and pressurized fluid is vented therefrom.

7. The coupler as claimed in claim 1, the controller comprising at least one magnet valve positioned in-line with at least one pressure transducer, wherein the at least one pressure transducer is configured to relay an electric signal to the controller based on the amount of pressure supplied to the at least one pneumatic cylinder.

8. The coupler as claimed in claim 7, further comprising at least one linear transducer operatively connected to the controller and the at least one pneumatic cylinder, wherein the at least one linear transducer is configured to relay an electric signal to the controller based on the linear displacement of the at least one pneumatic cylinder.

9. The coupler as claimed in claim 1, further comprising at least one linear transducer operatively connected to the controller and the at least one pneumatic cylinder, wherein the at least one linear transducer is configured to relay an electric signal to the controller based on the linear displacement of the at least one pneumatic cylinder.

10. The coupler as claimed in claim 1, wherein the measured angular position of the bogie relative to a body of the railway car is a measured numerical value.

11. A railway car coupler for coupling railway cars, the railway car coupler comprising:

a coupler anchor connected to a railway car body;

a coupler mechanism pivotable relative to the coupler anchor from an on-center position to an off-center position in a substantially horizontal plane; and a coupler positioning device for centering the coupler mechanism relative to the coupler anchor, the coupler positioning device comprising:

a controller adapted for receiving signal information from a bogie directed to a measured angular position of the bogie relative to the railway car body; and at least one pneumatic cylinder for pivoting the coupler mechanism, wherein the controller controls the operation of the at least one pneumatic cylinder in response to the signal information received from the bogie.

12. The railway car coupler as claimed in claim 11, wherein the at least one pneumatic cylinder comprises a first pneumatic cylinder and a second pneumatic cylinder.

13. The railway car coupler as claimed in claim 12, wherein each pneumatic cylinder is controlled independently by the controller.

14. The railway ear coupler as claimed in claim 11, wherein a first end of the at least one pneumatic cylinder is positioned on the coupler anchor and a second end of the at least one pneumatic cylinder is positioned on the coupler mechanism.

15. The railway car coupler as claimed in claim 11, further comprising a cutout cock positioned on the coupler mechanism, wherein the cutout cock is configured to vent pressurized fluid from the at least one pneumatic cylinder to permit manual positioning of the coupler mechanism.

16. The railway car coupler as claimed in claim 11, further comprising a mechanical switch positioned on the coupler mechanism, wherein the mechanical switch is configured to detect when the coupler is coupled with an adjacent coupler, and wherein, upon activation of the mechanical switch, the at least one pneumatic cylinder is isolated and pressurized fluid is vented therefrom.

17. The railway car coupler as claimed in claim 11, the controller comprising at least one magnet valve positioned in-line with at least one pressure transducer, wherein the at least one pressure transducer is configured to relay an electric signal to the controller based on the amount of pressure supplied to the at least one pneumatic cylinder.

18. The railway car coupler as claimed in claim 17, further comprising at least one linear transducer operatively connected to the controller and the at least one pneumatic cylinder, wherein the at least one linear transducer is configured to relay an electric signal to the controller based on the linear displacement of the at least one pneumatic cylinder.

19. The railway car coupler as claimed in claim 11, at least one linear transducer operatively connected to the controller and the at least one pneumatic cylinder, wherein the at least one linear transducer is configured to relay an electric signal to the controller based on the linear displacement of the at least one pneumatic cylinder.

20. A method for the automated positioning of a railway car coupler, comprising the steps of:

a) measuring an angular position of a bogie relative to a body of a railway car;

b) sending signal information relating to the angular position of the bogie to a controller; and c) adjusting pressure provided to at least one pneumatic cylinder operatively connected to a coupler based on the signal in formation received by the controller, thereby positioning the coupler in a desired position in a substantially horizontal plane.

21. The method for the automated positioning of a railway car coupler as claimed in claim 20, wherein the at least one pneumatic cylinder comprises a first pneumatic cylinder and a second pneumatic cylinder, wherein the controller is configured to adjust the pressure of each pneumatic cylinder independently of one another.

* * * * *